US006213387B1

(12) United States Patent
Zinke

(10) Patent No.: US 6,213,387 B1
(45) Date of Patent: Apr. 10, 2001

(54) PACKAGED SNACK-FOOD AND CARTON

(75) Inventor: David D. Zinke, Baltimore, MD (US)

(73) Assignee: Ann's House of Nuts, Inc., Jessup, MD (US)

( * ) Notice: Subject to any disclaimer, the term of this patent is extended or adjusted under 35 U.S.C. 154(b) by 0 days.

(21) Appl. No.: 09/383,379

(22) Filed: Aug. 26, 1999

(51) Int. Cl.[7] ..... B65D 25/34; B65D 25/54

(52) U.S. Cl. ..... 229/116.1; 229/162; 426/115

(58) Field of Search ..... 426/115; 383/36, 383/104; 229/116.1, 162; D9/305, 416, 431, 432, 433; 206/822

(56) References Cited

U.S. PATENT DOCUMENTS

| | | | | |
|---|---|---|---|---|
| D. 14,935 | | 4/1884 | Rixford | D9/432 |
| D. 39,142 | | 2/1908 | Marcuse | D9/474 |
| D. 197,147 | * | 12/1963 | Shapiro | D9/418 |
| D. 290,345 | | 6/1987 | Abe | D9/431 |
| D. 395,005 | | 6/1998 | Burton | D9/431 |
| D. 411,102 | * | 6/1999 | Planchard | D9/305 |
| D. 428,337 | * | 7/2000 | Persson et al. | D9/433 |
| 2,147,349 | | 2/1939 | Piquerez | 222/107 |
| 2,290,359 | | 7/1942 | Ringler | 206/362.4 |
| 3,079,062 | | 2/1963 | Craddock | 229/116 |
| 3,302,845 | * | 2/1967 | Gould | 229/112 |
| 4,042,110 | | 8/1977 | Guernsey | 206/459.1 |
| 4,063,679 | | 12/1977 | Henry | 229/108.1 |

* cited by examiner

*Primary Examiner*—Keith Hendricks
*Assistant Examiner*—Robert Madsen
(74) *Attorney, Agent, or Firm*—Nath & Associates PLLC; Gary N. Nath; Todd L. Juneau

(57) ABSTRACT

Here is described a carton comprising: a rectangular contents-retaining base having a length greater than its width; a front panel carried by the base, the front panel having a right edge, a left edge, a bottom edge, and a top edge; and having means for closing the carton. This means comprises: a top flap hinged at the top edge of the front panel and a tab carried by the top flap. The carton also has a back panel carried by the base, the back panel having: a right edge, a left edge, a bottom edge, and a top edge, and a tab receiving slot. The carton further has a triangular right side panel carried by the base and joining the right edge of the front panel with the right edge of the back panel; a triangular left side panel carried by the base and joining the right edge of the front panel with the right edge of the back panel; wherein the top flap is hinged at a substantial angle "a" to the base. The top edge of the front panel is substantially equal in length to the sum of the length and width of the base whereby the right side panel and the left side panel flare upwardly outwardly from the base. A carton blank for making the carton is described.

3 Claims, 4 Drawing Sheets

PACKAGED SNACK-FOOD AND CARTON

FIELD OF THE INVENTION

This invention relates to an improved snack-food carton, a carton blank for forming the carton and to an improved packaged snack-food comprising the carton.

BACKGROUND OF THE INVENTION

Prior art snack-food cartons suffer from a number of disadvantages. Consumers of snack food frequently want the convenience of immediately eating the snack food directly from the carton. This is done by opening the top of the carton, then reaching the hand into the carton, then withdrawing a morsel of the snack food, then immediately placing this morsel in the mouth. The top of the open prior art cartons are frequently too small to permit convenient passage of the hand. This causes undesirable contact between the hand and the inside of the walls. This contact scratches the hand and can transfer particles of food, salt or seasonings from the carton to the hand. In order to avoid contact with the top of the carton, the consumer resorts to various strategies.

One strategy is to tear the top of the carton to reduce the distance between the top and the morsels inside. While this strategy does decrease the distance to the morsels it creates other problems. Food particles can be dislodged during the tearing process. If a portion of the carton is completely torn off it creates a disposal problem. If only partially torn off it waves about undesirably dropping food particles outside the carton.

Another strategy is to tilt the bag to an almost horizontal position, sometimes with a shaking motion to advance the morsels toward the open top. This strategy too has a number of problems. One problem is that a certain degree of skill is required. This degree of skill is frequently not possessed by consumers who are either handicapped or of tender years. Another problem is that the morsels can fall to the ground. In any case the open top of the carton in the horizontal position is, of course, no bigger than it was in the vertical position.

Another problem in prior snack food cartons is that the consumer cannot see the food they are purchasing. This leads to sales resistance.

Many prior art cartons for snack food cannot be filled by existing packaging machinery.

SUMMARY OF THE INVENTION

Accordingly it is an object of the present invention to provide an improved snack-food carton substantially free of one or more of the disadvantages of prior snack-food cartons.

Another object is to provide an improved snack-food carton which has a large open top.

Still another object is to provide an improved snack-food carton which has contents which are easily accessed.

Yet another object is to provide an improved snack-food carton which can be easily filled by existing packaging machinery.

BRIEF DESCRIPTION OF DRAWINGS

The above and other objects are accomplished by providing an improved snack-food carton as described in the following description and drawings wherein.

DETAILED DESCRIPTION

According to the present invention there is provided a carton comprising: a rectangular contents-retaining base having a length greater than its width; a front panel carried by the base, the front panel having a right edge, a left edge, a bottom edge, and a top edge; and having means for closing the carton. This means comprises: a top flap hinged at the top edge of the front panel and a tab carried by the top flap. The carton also has a back panel carried by the base, the back panel having: a right edge, a left edge, a bottom edge, and a top edge, and a tab receiving slot. The carton further has a triangular right side panel carried by the base and joining the right edge of the front panel with the right edge of the back panel; a triangular left side panel carried by the base and joining the right edge of the front panel with the right edge of the back panel; wherein the top flap is hinged at a substantial angle "a" to the base. The top edge of the front panel is substantially equal in length to the sum of the length and width of the base whereby the right side panel and the left side panel flare upwardly outwardly from the base.

According to another aspect of the present invention there is provided a packaged snack-food comprising the carton of the present invention and snack food within the carton.

According to still another object of the present invention there is provided a carton blank. This carton blank can be easily manufactured by known carton making machinery and can be filled by known carton filling machinery.

The carton of the present invention can be constructed of any planar material but is preferably constructed of a sheet of paperboard. Plain paperboard can be used but the paper board preferably has a moisture vapor barrier. Any moisture vapor barrier used in the past can be employed such as wax, polyethylene or aluminum.

Any transparent material heretofore used in food packaging, or invented in the future for use in food packaging, can be employed to form the window of the carton of the present invention. Examples of suitable transparent materials include among others: cellophane and polyethylene.

The carton can have a widely varying size but in a preferred embodiment it is of a size to be easily held between the thumb and fingers of one hand. This facilitates withdrawing of the snack food from the carton. In one preferred embodiment, the carton has a base which has a length from about 3 to about 15 centimeters (about 1 to about 9 inches) and preferably from about 5 to about 10 centimeters (about 2 to about 4 inches). The top flap is hinged at an angle "a" of from about 5° to about 40° to the base and preferable at about 10° to about 25° to the base.

The carton can contain any snack food but preferably contains a snack food which is bite-sized. Examples of such snack food include among others: potato chips, candy, nuts and mixtures thereof.

Figure 1:
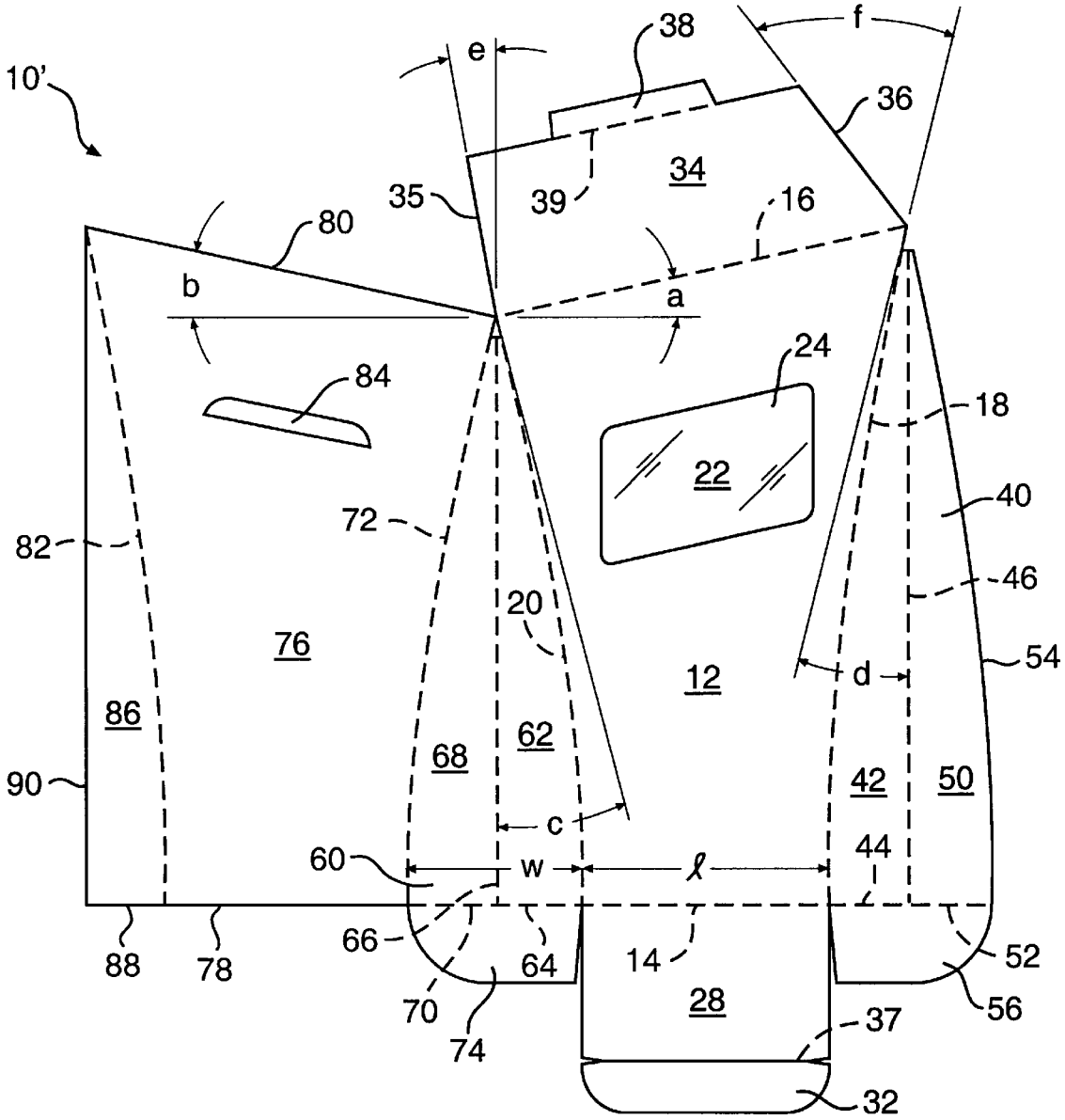
FIG. 1 is a view of a snack-food carton blank of the present invention.

Referring now to the drawings in general, in which like elements are identified by the same numeral throughout the several views, and in particular to FIG. 1 there is shown paperboard carton blank 10' of the present invention useful to form the carton 10. The carton-blank 10' comprises a front panel 12. In the front panel 12 the bottom terminates in a bottom horizontal crease line 14. The top terminates in a top crease line 16 which is inclined to the horizontal crease line 14 at an angle "a" of about 20° to the horizontal crease line 14. The right edge terminates in an arcuately curved vertical crease line 18. The left side terminates in an arcuately curved vertical crease line 72.

A window 22 is in the front panel 12. This window 22 is covered with a sheet 24 of transparent material whereby any consumer (not shown) can view from the outside any snack-food (not shown) within the carton 10 whenever the carton 10 is assembled and filled with the snack-food as explained more fully below.

The carton blank 10' further comprises a bottom flap 28. The bottom flap 28 constitutes means for closing the bottom of the carton 10 when assembled. One side of the bottom flap 28 is hinged on the crease line 14 of the front panel 12. The other side of the bottom flap 28 terminates in a tab crease line 37.

The carton blank 10' is provided with a bottom tab 32 one side of which is hinged about the tab crease line 37 of the bottom flap 28. The carton blank 10' has top flap 34 one side of which is hinged about the top crease line 16 of the top of the front panel 12, the other side of which terminates in a tab crease line 39. The carton blank 10' also has a top tab 38 hinged about the tab crease line 39 of the top flap 34.

The carton has a right side panel 40 and a left side panel 60. The right side panel 40 comprises a triangular front right demi-portion 42 with a curved hypotenuse wherein the bottom terminates in a horizontal crease line 44. The right edge terminates in a right crease line 46. The left edge terminates in the crease line 18 of the front panel 12. The crease line 18 is also in the form of an arcuate hypotenuse.

The right side panel 40 also has a triangular back right demi-portion 50 with a curved hypotenuse wherein the bottom terminates in a horizontal crease line 52; the left edge terminates in the crease line 46 of the front right demi-portion 42; and the right edge 54 terminates in an arcuate hypotenuse.

The carton blank 10' is equipped with a right ear 56 hinged about the horizontal crease line 44 of the front right demi-portion 42 and the crease line 52 of the back right demi-portion 50 of the right side panel 40.

The carton blank 10' has a left side panel 60 comprising a triangular front right demi-portion 62 with a curved hypotenuse wherein: the bottom terminates in a horizontal crease line 64, the left edge terminates in a vertical crease line 66, the right edge terminates in a the crease line 20 of the front-panel 12. There is also a triangular back right demi-portion 68 with a curved hypotenuse wherein: the bottom terminates in a horizontal crease line 70, the right edge terminates in the vertical crease line 66 of the front left demi portion 62, the left edge terminates in an arcuate crease line 72 in the form of an arcuate hypotenuse.

The carton blank 10' has a left ear 74 hinged about the horizontal crease line 70 of the back left demi-portion 68 and the crease line 64 of the front left demi-portion 62 of the left side panel 60.

In the back panel 76, the bottom terminates in a bottom horizontal edge 78, the top terminates in a top edge 80, the right side terminates in the crease line 72 of the back left demi-portion 68, the left side terminates in an arcuate crease line 82. The back panel 76 has a tab-receiving slot 84 in the back panel 76 adapted to receive the top tab 38.

In order to glue the carton blank 10' together the carton blank 10' has a triangular side flap 86 having a bottom edge 88, a vertical left edge 90 and terminating on the right at the arcuate crease line 72 of the left side of the back panel 76.

Certain angles are important to the preferred embodiment represented by the carton blank 10'. In the carton blank 10' the angle "a" between the crease line 14 of the bottom of the front panel 12 and the crease line 16 of the top of the front panel 12 generally has a value between about 5° and about 40°, and preferably from about 10° to about 25°. By virtue of this angle the right side panel 40 is taller than is the left side panel 60. When the carton 10 opened and rotated about 90° to be horizontal, the longer fight panel forms a tray from which to retrieve snack food from within the carton without the hand contacting any other portion of the carton 10.

The angle "b" between the top 80 of the back panel 76 and the bottom edge 78 of the back panel 78 is substantially equal to the angle "a" so that the two sides of the top will be parallel when the carton 10 is closed.

The angle "c" between the left crease line 20 of the front panel 12 and the vertical crease line 66 is between about 10° and 25° to provide the desired amount of outward flaring of the side panels 40, 60.

The angle "d" between the right crease line 18 of the front panel 12 and the vertical crease line 46 of the side panel 40 is equal to the angle "c" so that the assembled carton 10 will have a pleasing appearance even though the side panels 40, 60 are outwardly flared.

The angle "e" between the left edge 35 of the top flap 34 and the vertical crease line 66 is equal to the angle "c" so that when the top flap 34 is folded along crease line 16 that the edge 35 will lie along the fold line 72.

The angle "f" between the right edge 36 of the top flap 34 and the crease line 18 of the right side of the front panel 12 is equal to the sum of angles "a" and "c" so that when the top flap 34 is folded along crease line 16 that the edge 36 will lie along the fold line 18.

The front panel 12 has a given length "l", of about 8 centimeters (about 3 inches). The left side panel 60 has a given width "w" of about 5 centimeters (about 2 inches). This makes the carton 10 easy to hold in one hand. In the embodiment shown the length of the top flap 34 measured along the crease line 16 of the front panel is greater than the sum of the length "l" and the width "w".

Figure 2:
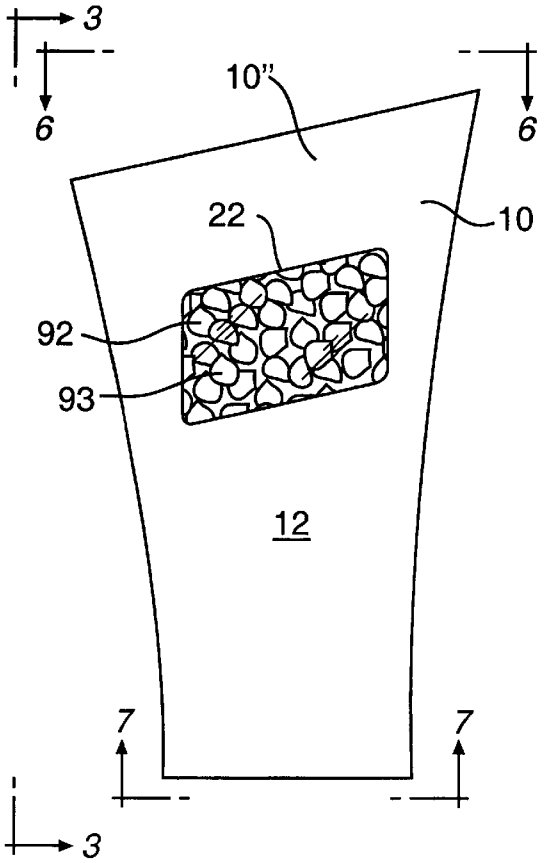
FIG. 2 is a front view of the packaged snack food of the present invention utilizing an assembled snack-food carton of FIG. 1.
Figure 3:
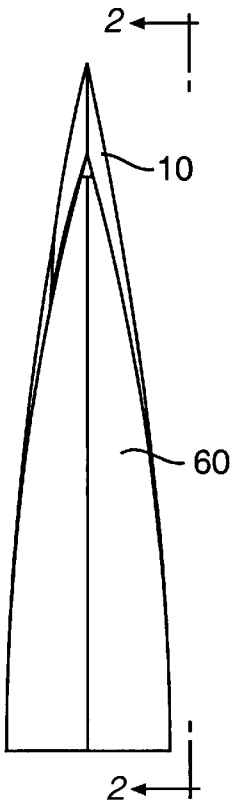
FIG. 3 is a view of the left side of the packaged snack-food of the present invention taken along Line 3—3 of FIG. 2.

Referring now to FIGS. 2 and 3, there is shown the packaged snack-food 10" comprising a carton 10 with nuts, 92, 93 visible through the window 22.

Figure 4:
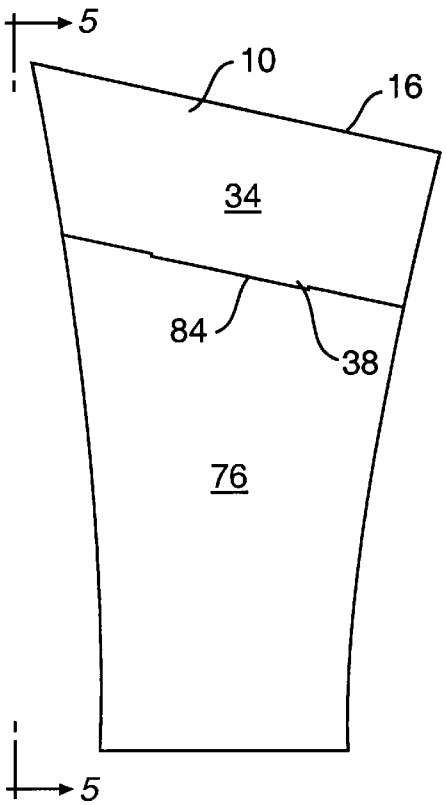
FIG. 4 is a view of the back of the packaged snack-food of the present invention.
Figure 5:
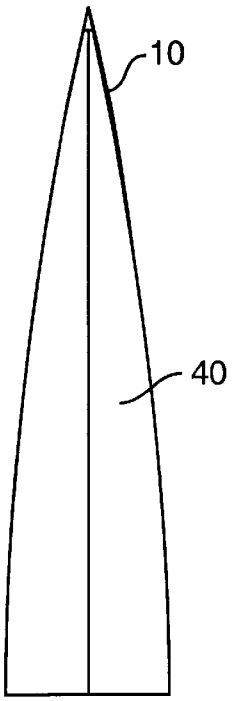
FIG. 5 is a view of the right side of the packaged snack-food of the present invention taken along Line 5—5 of FIG. 4.
Figure 8:
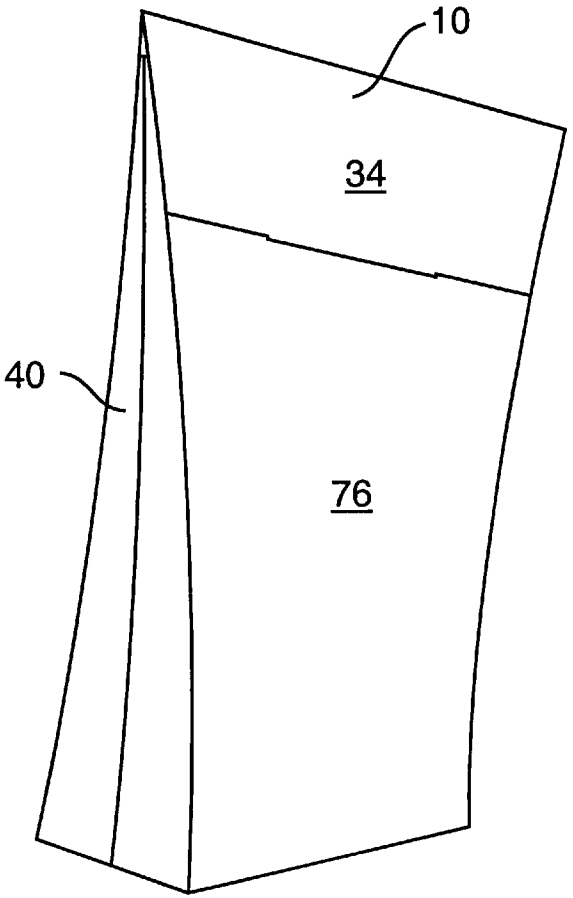
FIG. 8 is a perspective view from the right rear corner of the packaged snack-food of the present invention.
Figure 6:
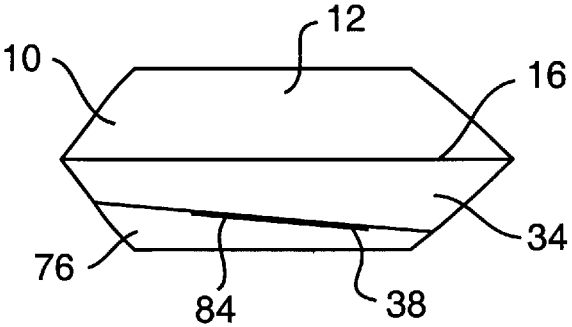
FIG. 6 is a view of the top of the packaged snack-food of the present invention taken along Line 6—6 of FIG. 2.

FIGS. 4, 5, and 6 show the top flap 34 folded along the crease line 16 with the top tab 38 inserted in the slot 84 of the back panel 76.

Figure 7:
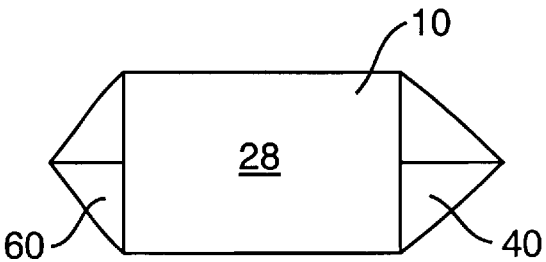
FIG. 7 is a view of the bottom of the packaged snack-food of the present invention taken along Line 7—7 of FIG. 2.

FIG. 7 shows the bottom flap 28 completely closing the bottom of the carton 10.

Figure 9:
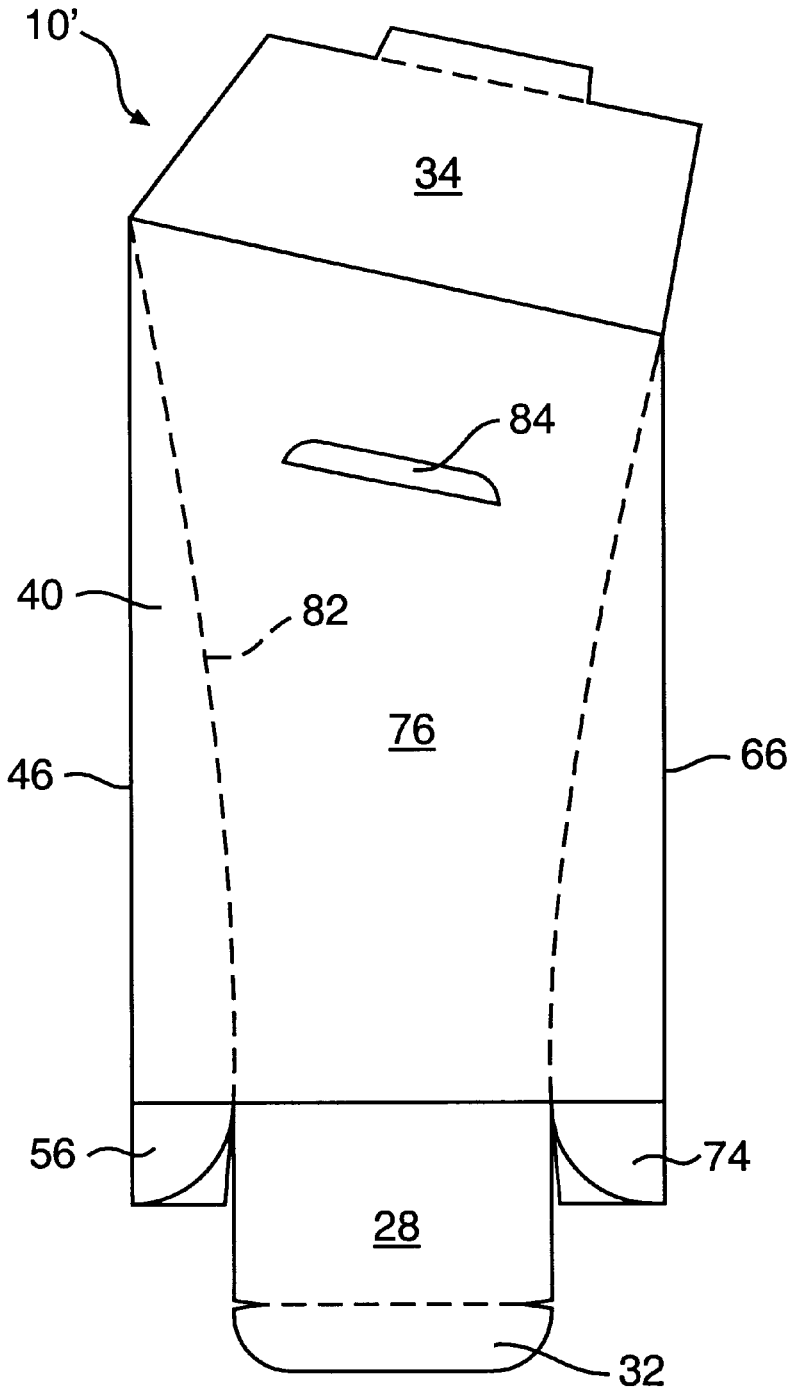
FIG. 9 is a view of the carton-blank of FIG. 1, after gluing but prior to fully forming the carton-blank into a carton.

Referring now to both FIGS. 1 and 9, it can be seen how the carton blank 10' is converted into the carton 10. To convert the carton-blank 10' into the carton 10, glue is applied to the side flap 86. The right demi-portion 50 is folded 180° about the fold line 46. The back panel 76, flap 86 and back left demi-portion 68 are folded about crease line 66 whereupon the demi-portion 50 contacts the glue on the flap 86. The glue is permitted to dry. As shown in FIG. 9, the carton blank 10' is planar with the fold lines 46 and 66 parallel to each other. After the glue is dried the carton is further assembled by causing fold lines 82, 72, 20 and 18 to be folded at right angles. The ears 56, 74 are bent at right angles, the bottom flap 28 is bent at right angles about the crease line 14 and the bottom tap 32 inserted inside the container 10. The container 10 is then filled with snack food, whereupon the top flap 34 is folded about cease line 16 causing the top tab 38 to be inserted in the slot 84.

The snack food can be placed directly in the carton 12 or can be placed in a bag to form a snack-food-filled bag which is then placed in the carton 12. The bag can be filled with plain air, desiccated air or can be evacuated. In other words the bag can be vacuum packed.

Although the invention has been described in considerable detail with respect to certain preferred embodiments thereof, it will be understood that variations are within the skill of the art without departing from the spirit of the invention as described above and as defined in the appended claims.

What is claimed is:

1. A paperboard carton (10) blank comprising:

A. a front panel having a bottom, a top, a right side, and a left side (12) wherein;

the bottom terminates in a bottom horizontal crease line (14), the top terminates in a top crease line (16) which is inclined to the horizontal crease line (14) at an angle a of about 20° to the horizontal crease line (14), the right side terminates in an arcuately curved vertical crease line (18), the left side terminates in an arcuately curved vertical crease line (72), a window (22) in the front panel (12) wherein said window (22) is covered with a sheet (24) of transparent material whereby any consumer can view from the outside any snack-food within the carton (10) whenever the carton (10) is assembled and filled with said snack-food;

B. a bottom flap (28) constituting means for closing the bottom of the carton (10) when assembled, one side of said bottom flap (28) being hinged on the bottom horizontal crease line (14) of the front panel (12); the other side of said bottom flap (28) terminating in a tab crease line (37);

C. a bottom tab (32) one side of which is hinged about the tab crease line (37) of the bottom flap (28);

D. a top flap (34) one side of which is hinged about the top crease line (16) of the top of the front panel (12); the other of which terminates in a tab crease line (39);

E. a top tab (38) hinged about the tab crease line (39) of the top flap (34);

F. a right side panel (40) comprising:

a triangular front right demi-portion (42) with a curved hypotenuse wherein the triangular front right demi-portion has a bottom, a right edge, and a left edge, wherein:

the bottom terminates in a horizontal crease line (44), the right edge terminates in a right crease line (46), and the left edge terminates in the crease line (18) of the front panel (12) wherein said crease line is in the form of an arcuate hypotenuse; and a triangular back right demi-portion (50) with a curved hypotenuse wherein the triangular back right demi-portion has a bottom, a right edge, and a left edge, wherein:

the bottom terminates in a horizontal crease line (52), the left edge terminates in the crease line (46) of the front right demi-portion (42); and the right edge (54) terminates in an arcuate hypotenuse;

G. a right ear (56) hinged about the horizontal crease line (44) of the front right demi-portion (42) and the crease line (52) of the back right demi-portion (50) of the right side panel (40);

H. a left side panel (60) comprising:

a triangular front right demi-portion (62) with a curved hypotenuse wherein the triangular front right demi-portion has a bottom, a right edge, and a left edge, wherein:

the bottom terminates in a horizontal crease line (64), the left edge terminates in a vertical crease line (66), the right edge terminates in the crease line (20) of the front panel (12);

a triangular back right demi-portion (68) with a curved hypotenuse wherein the triangular back right demi-portion has a bottom, a right edge, and a left edge, wherein:

the bottom terminates in a horizontal crease line (70), the right edge terminates in the vertical crease line (66) of the front left demi portion (62), the left edge terminates in an arcuate crease line (72) in the form of an arcuate hypotenuse;

I. A left ear (74) hinged about the horizontal crease line (70) of the back left demi-portion (68) and the crease line (64) of the front left demi-portion (62) of the left side panel (60);

J. a back panel having a bottom, a top, a right side, a left side, and a tab receiving slot (76) wherein:

the bottom terminates in a bottom horizontal edge (78), the top terminates in a top edge (80)

the right side terminates in the crease line (72) of the back left demi-portion (68), the left side terminates in an arcuate crease line (82)

the tab-receiving slot (84) in the back panel (76) adapted to receive the top tab (38);

K. a triangular side flap (86) having a bottom edge (88), a vertical left edge (90) and terminating on the right at the arcuate crease line (72) of the left side of the back panel (76); wherein:

an angle a between the crease line (14) of the bottom of the front panel (12) and the crease line (16) of the top of the front panel (12) has a value between about 10° and 25°;

an angle b between the top (80) of the back panel (76) and the bottom edge (78) of the back panel (78) is substantially equal to the angle a;

an angle "c" between the left crease line (20) of the front panel (12) and the vertical crease line (66) is between about 10° and 25°;

an angle d between the right crease line (18) of the front panel (12) and the vertical crease line (46) of the side panel (40) is equal to the angle c;

an angle e between the left edge (35) of the top flap (34) and the vertical crease line (66) is equal to the angle c;

an angle f between the right edge (36) of the top flap (34) and the crease line (18) of the right side of the front panel (12) is equal to the sum of angles a and c;

the front panel (12) has a given length l, the left side panel (60) has a given width w and wherein the length of the top flap (34) measured along the crease line (16) of the front panel is greater than the sum of the length l and the width w.

2. The carton 10 claim 1 wherein the carton is constructed of paperboard which has a moisture vapor barrier.

3. The carton of claim 1 wherein the carton is constructed of paperboard which has a moisture vapor barrier selected from the group consisting of wax, polyethylene and aluminum.

* * * * *